United States Patent [19]

Mino et al.

[11] 4,347,991

[45] Sep. 7, 1982

[54] GROOVED TRAVERSE DRUM FOR USE IN DRUM WINDER

[75] Inventors: Masao Mino; Takeshi Ohno, both of Yao, Japan

[73] Assignee: Kabushiki Kaisha Mino Seisakusho, Yao, Japan

[21] Appl. No.: 922,494

[22] Filed: Jul. 6, 1978

[51] Int. Cl.[3] ..... B65H 54/28; B65H 54/48

[52] U.S. Cl. ..... 242/43.2

[58] Field of Search ..... 242/43.2

[56] References Cited

U.S. PATENT DOCUMENTS

| | | | |
|---|---|---|---|
| 1,749,355 | 3/1930 | Reece | 242/43.2 |
| 1,918,210 | 7/1933 | McKean | 242/43.2 |
| 2,998,203 | 8/1961 | Pitts | 242/43.2 |
| 3,147,930 | 9/1964 | Fossen et al. | 242/43.2 |
| 3,346,206 | 10/1967 | Fossen | 242/43.2 |

FOREIGN PATENT DOCUMENTS

| | | | |
|---|---|---|---|
| 1074269 | 3/1954 | France | 242/43.2 |
| 674413 | 6/1952 | United Kingdom | 242/43.2 |
| 757966 | 9/1956 | United Kingdom | 242/43.2 |

*Primary Examiner*—Stanley N. Gilreath

*Attorney, Agent, or Firm*—Armstrong, Nikaido, Marmelstein & Kubovcik

[57] ABSTRACT

A grooved traverse drum for use in a drum winder is provided with a recess which facilitates the cutting and removal of a yarn coiled around the drum. The recess is formed by modifying that one of the lateral walls forming an interrupted wider yarn guide groove portion at a crossover point of the yarn guide groove which does not contribute to the guiding of the yarn, in such a manner as to widen the groove bottom.

4 Claims, 3 Drawing Figures

GROOVED TRAVERSE DRUM FOR USE IN DRUM WINDER

BACKGROUND OF THE INVENTION (a) Field of the Invention

The present invention relates to a grooved traverse drum for use in a drum winder for winding parallel cheeses or cone cheeses.

(b) Description of the Prior Art

It is known in the art that, during the operation of the drum winder, the yarn can break and coil around the grooved traverse drum (hereinafter referred to simply as the drum).

There has been a strong desire for means for facilitating the cutting and removal the coils of yarn quickly and easily, and some have already been proposed.

For example, it has been proposed to provide an elongated recess across a wider yarn guide groove portion at a crossover point of the yarn guide groove of the drum for cutting and removing the coils of yarn around the drum.

However, since the recess according to the above proposal has a narrow width, it is inconvenient for cutting and removing the coils of yarn around the drum and the yarn guide surface of the drum can be damaged by a tool, such as a knife, with which to cut the yarn. Further, with this recess, the quick removal of the yarn is impossible.

Moreover, since the recess according to the above proposal must be newly provided across a wider yarn guide groove portion, the processing is time-consuming and adds to the manufacturing cost of the drum. The recess can have adverse effects on the wound yarn layers.

SUMMARY OF THE INVENTION

The present invention has for its object the provision of a grooved traverse drum for use in a drum winder which eliminates the disadvantages described above and which is designed so that the coils of yarn can be cut and removed easily and quickly, without substantially increasing the manufacturing cost of the drum.

Another object of the invention is to provide a grooved traverse drum for use in a drum winder wherein the means for facilitating the cutting and removal of the coils of yarn around the drum has no possibility of interfering with the yarn winding operation of the drum winding and disturbing the wound yarn layers during the operation of the drum winder.

A further object of the invention is to provide a grooved traverse drum for use in a drum winder which facilitates the cutting and removal of yarn with a tool, such as a knife, used to cut the yarn and which has no possibility of damaging the yarn guide surface of the drum and the surface thereof which contacts the wound yarn layer.

The invention is substantially characterized by applying said means to an interrupted wider yarn guide groove portion at a crossover point of the yarn guide groove of the drum.

More particularly, it is characterized by applying said means to that one of the two lateral wall surfaces forming said interrupted wider yarn guide groove portion which does not contribute to the guiding of the yarn.

In other words, the invention is characterized in that it is based on the finding that the greater part of one of the two lateral wall surfaces forming said interrupted wider yarn guide groove portion does not at all contribute to the guiding of the yarn.

Therefore, it is clear that the means according to the invention does not interfere with the guiding of the yarn.

According to the invention, which is based on the finding that that portion of said lateral wall surfaces of the yarn guide groove portion which does not contribute to the guiding of the yarn occupies a considerably large area, said portion is utilized to permit the cutting and removal of the coils of yarn to be effected over a wide region so that they can be cut and removed immediately anywhere in said wide region.

Further, according to the invention, since the wider yarn guide groove portion is utilized, it is possible to minimize the amount of processing for applying said means.

In fact, according to the invention, in making a drum the lateral wall surface of the wider yarn guide groove portion which does not contribute to the guiding of yarn is somewhat modified to increase the width of the groove. Therefore, this widening of the groove can be attained by somewhat modifying at said portion the conventional processing which has been performed to form said yarn guide groove. This does not add to the manufacturing cost.

When the lateral wall surface of the wider yarn guide groove portion which does not contribute to the guiding of the yarn is processed to widen the groove, as described above, it is possible to gradually change the rate of which the groove is widened, since said region is long.

The edge of the lateral wall surface modified by said processing which meets the drum surface has no points at which the direction changes sharply as in the conventional edge and only forms a gentle curve. Therefore, during the operation of the drum winder, said edge will not adversely affect the wound yarn layers or induce the dislocation of the windings of yarn.

In fact, in the invention, said edge changes in such a manner that the groove is gradually widened from one end of said wide region to the center thereof and then gradually narrowed from the said center to the other end of said region, resuming the usual (conventional) groove width.

Further, according to the invention, the bottom of the groove in the region modified as described above is widened and made locally deeper to define said recess so that the yarn coiled around the drum at this portion will be out of contact with the drum (in fact, the yarn is separated from the drum at the locally deepened portion in a bridge fashion).

Therefore, the yarn coiled around the drum can be easily cut and removed.

Further, since said recess will never come in contact with the yarn when normally guiding the yarn, even if this portion is damaged as by a knife no trouble will be caused to the guiding of the yarn.

Further, according to the invention, the lateral wall surface of a wider yarn guide groove portion which guides the yarn and which is opposed to the portion where the lateral wall surface of said portion which does not contribute to the guiding of the yarn is outwardly modified has a sharper angle than the conventional angle, whereby the area of the bottom of said recess can be increased, facilitating the cutting and removal of the yarn coiled around the drum, and also improving the guiding of the yarn.

The invention will now be described in more detail with reference to the accompanying drawing showing an embodiment thereof.

DESCRIPTION OF THE PREFERRED EMBODIMENT

Figure 1:
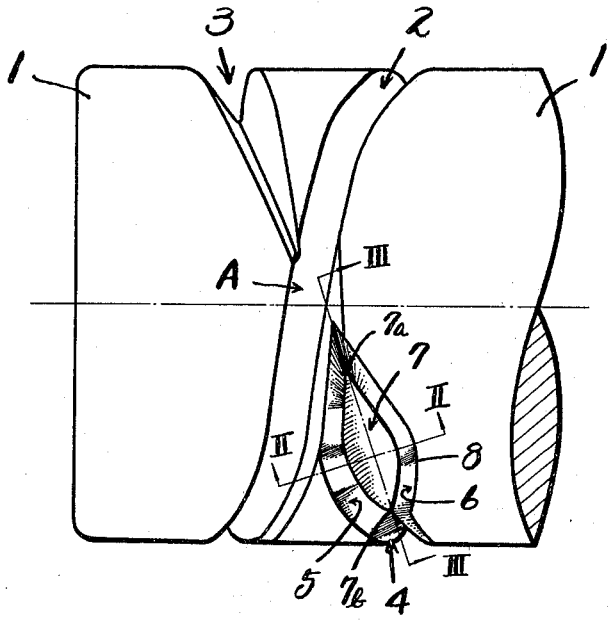
FIG. 1 is a fragmentary view showing a grooved traverse drum for use in a drum winder having the invention incorporated therein.

In FIG. 1, the numeral 1 generally designates a drum, which has a spiral yarn guide groove on its peripheral surface, as is known in the art. Usually, the yarn guide groove forms crossover points at different positions on the peripheral surface of the drum.

Usually, the number of crossover points is at least 2 for each drum, one of which is shown in FIG. 1.

As is known in the art, the yarn guide groove serves to guide the yarn from one end to the other end of the drum 1 and then from said other end back to said one end. Therefore, it has the function of repeatedly guiding the yarn both ways.

A crossover point is indicated by A in FIG. 1, and yarn guide groove portions forming this crossover point are indicated by the numerals 2, and 3, 4, respectively, for convenience of description.

Once yarn guide groove portion indicated by the numeral 2 is deep and continuous at said crossover point while the other yarn guide groove portion is interrupted by said yarn guide groove portion 2 to form yarn guide portions 3 and 4.

Usually, the yarn guide groove portion indicated by the numeral 3 is narrowed and also shallowed at the crossover point A.

Further, the yarn guide groove portion indicated by the numeral 4 is widened and relatively deepened at the crossover point A.

Of lateral walls 5 and 6 forming said yarn guide groove portion 4, one lateral wall 5 contributes to the guiding of the yarn, while the other lateral wall 6 does not contribute to the guiding of the yarn so far as the region shown in FIG. 1 is concerned.

The present invention is intended to provide said yarn guide portion 4 with two functions, the guiding of the yarn and the cutting and removal of the yarn which is realized by a recess.

The recess is shown at 7 in the figures.

In forming the recess 7, the lateral wall 6 of the yarn guide groove portion 4 which does not contribute to the guiding of the yarn is relieved outwardly, i.e., in the direction in which the groove width will be thereby increased, thereby substantially widening the groove. The relieving region, i.e., the region in which the lateral wall 6 is modified, is the region which does not contribute to the guiding of the yarn, or stated more concretely, it is the region illustrated in FIG. 1.

This region, as is clear from FIG. 1, occupies a considerably large space. Actually, this region can be ascertained by operating the drum winder and will be found to occupy a considerably large space.

According to the invention, the lateral wall 6 is modified throughout said region in such a manner that the groove is gradually widened from one end of said region to the center thereof and then gradually narrowed from said center to the other end, resuming the original (conventional) groove width.

Therefore, the edge 8 of the above-described modified portion which meets the surface of the drum 1 is a gentle curve leading a bulge such that the groove width is greatest at the middle as compared with the conventional edge, and it is believed that such edge will have no adverse effect on the operation of the drum winder and on the wound yarn layers.

Figure 3:
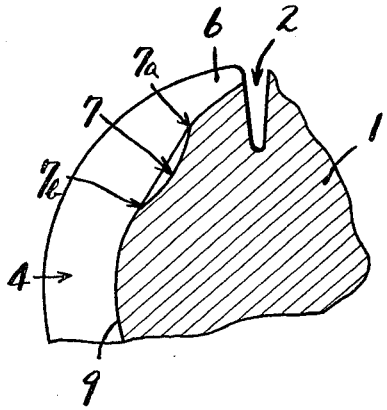
FIGS. 2 and 3 are sectional views taken along the lines II—II and III—III, respectively, of FIG. 1.

The recess 7 has an arcuate cut formed in the groove bottom 9 and extending between ends *7a* and *7b*, as shown in FIG. 3.

Figure 2:
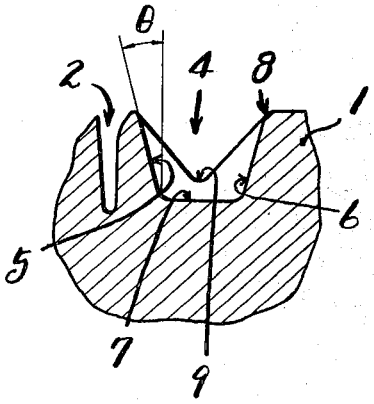

The recess 7 is widest at the middle, as shown in FIGS. 1 and 2.

Therefore, the recess 7 in the illustrated embodiment is widest and deepest at the middle. Of course, the configuration of the recess 7 is not limited to the illustrated embodiment and other configurations may be used within the spirit and scope of the invention.

However, said arcuate cut is believed to be most advantageous to the processing.

In order to form said recess 7, it is sufficient to modify that lateral wall 6 of the yarn guide groove portion 4 which does not contribute to the guiding of the yarn, as described above, but if the angle of inclination $\theta$ of the other lateral wall 5 is made sharper than the conventional angle, it is possible to form a wider recess.

In the above case also, the lateral wall 5 will satisfactorily guide the yarn, never allowing the yarn to slip out of the yarn guide groove portion 4.

Particularly, when the yarn is guided by the yarn guide groove portion 4, the sharper angle of the lateral wall 5 will restrict the contact between the yarn and the lateral wall 5 to a place near the upper edge of the lateral wall 5, thus reducing the frictional resistance to the yarn and improving the guiding of the yarn.

As has been described so far, according to the present invention, a sufficiently wide recess can be formed, so that the yarn coiled around the drum can be cut and removed quickly, simply and easily. Moreover, there is no danger of damaging the yarn guiding inner surface of the drum. Particularly, since it is only necessary to modify the lateral wall of the yarn guide groove portion to some extent, the processing is very simple and easy and does not add to the manufacturing cost of the drum. The recess does not interfere with the guiding of the yarn and has no adverse effect on the wound yarn layers.

While a specific embodiment of the invention has been described in detail with reference to the accompanying drawing, it is to be understood that the invention is not limited thereto and that various changes and modifications may be made by those skilled in the art without departing from the spirit and scope of the invention.

What is claimed is:

1. A grooved traverse drum for use in a drum winder, said drum including a spiral yarn guide groove formed in the peripheral surface thereof, said spiral groove having a deep portion and a shallow portion crossing said deep portion, said shallow portion being interrupted where it crosses said deep portion defining an interrupted portion, said yarn guide groove having two sides, one of which guides said yarn in said groove, wherein said shallow portion of said yarn guide groove includes a widened portion extending from the interrupted portion thereof in the longitudinal direction of said yarn guide groove for a distance greater than the width of the widened portion, said widened portion being formed in the side of said yarn guide groove which is opposite said one side, said widened portion being formed contiguously with the remaining portion of said yarn guide groove, thereby minimizing the change of direction of a piece of yarn which passes through said widened portion, said widened portion including a recess formed in the bottom thereof wherein the yarn in the bottom of said widened portion bridges across said recess.

2. A grooved traverse drum as set forth in claim 1 wherein said widened portion is widest at the middle thereof in the longitudinal direction along said yarn guide groove and is narrowest at the ends thereof.

3. A grooved traverse drum as set forth in any one of claims 1–2 wherein said one side is inclined at a smaller angle of inclination than the one side of the remaining portion of said yarn guide groove, thereby widening the bottom of said widened portion.

4. A grooved traverse drum as set forth in claim 1 wherein said recess is an arcuate cut formed below the level of the bottom of said widened portion.

* * * * *